United States Patent [19]

Hiraishi et al.

[11] 4,224,061

[45] Sep. 23, 1980

[54] HIGH CORROSION RESISTANT AND HIGH STRENGTH MEDIUM CR AND LOW NI STAINLESS CAST STEEL

[75] Inventors: Hisashi Hiraishi, Kyoto; Toshiaki Morichika, Hirakata; Shinichi Murakami, Osaka; Katsutaro Akamatsu, Hirakata, all of Japan

[73] Assignee: Kubota Ltd., Osaka, Japan

[21] Appl. No.: 929,296

[22] Filed: Jul. 28, 1978

Related U.S. Application Data

[62] Division of Ser. No. 862,987, Dec. 20, 1978, abandoned.

[30] Foreign Application Priority Data

Jun. 30, 1977 [JP] Japan ..... 52/79195

[51] Int. Cl.[2] ..... C22C 39/20

[52] U.S. Cl. ..... 75/125; 75/128 W; 148/37

[58] Field of Search ..... 148/37, 38; 75/125, 75/128 W, 128 N

[56] References Cited

U.S. PATENT DOCUMENTS

| | | | |
|---|---|---|---|
| 3,376,780 | 4/1968 | Tanczyn | 148/38 |
| 3,551,142 | 12/1970 | Decroix | 75/125 |
| 3,567,434 | 3/1971 | Richardson | 75/125 |
| 3,795,507 | 3/1974 | Allen | 75/124 |
| 3,811,875 | 5/1921 | Goda | 75/125 |
| 3,926,685 | 12/1975 | Gueussier et al. | 148/37 |
| 4,055,448 | 10/1977 | Fujikura et al. | 75/125 |

FOREIGN PATENT DOCUMENTS 2417632 10/1974 Fed. Rep. of Germany ..... 75/128 W

OTHER PUBLICATIONS

Stahlschlussel, 10th Ed. 1974, p. 6.

*Primary Examiner*—L. Dewayne Rutledge
*Assistant Examiner*—Peter K. Skiff
*Attorney, Agent, or Firm*—Wenderoth, Lind & Ponack

[57] ABSTRACT

A high corrosion resistant and high strength medium Cr and low Ni stainless cast steel which is produced from material including predetermined amounts of elements at predetermined weight percentage and remaining portion substantially of Fe. When the above material is further subjected to heat treatments under predetermined conditions, stainless steels superior in yield strength and having stable corrosion resistance against circumstances influenced by strong acids are presented.

4 Claims, 2 Drawing Figures

HIGH CORROSION RESISTANT AND HIGH STRENGTH MEDIUM CR AND LOW NI STAINLESS CAST STEEL

This is a division of application Ser. No. 862,987, filed Dec. 20, 1977, now abandoned.

BACKGROUND OF THE INVENTION

The present invention relates to cast steel and more particularly, to medium chromium (Cr) low nickel (Ni) stainless cast steel especially having stable corrosion resistance against strong acids and a method of producing said cast steel.

Recently, with the remarkable development in the fields of chemical industry, paper-manufacturing industry, etc., requirements for materials having stable corrosion resistance have been increasing more and more. Although bronze has conventionally been employed extensively as a reliable material having sufficient corrosion resistance against strong acids, it has problems related to designing with respect to the demand for larger size of various facilities, due to its low allowable stress, elastic modulus and yield strength for structural material requiring high strengths. Accordingly, martensite stainless steel of 13 Cr group is generally employed for such purposes, while stainless steels of 18-8 and 18-8-Mo groups are generally used in circumstances subjected to influence of strong acids. Meanwhile, in the field of stainless steel, high Cr low Ni two phase stainless steel having higher strength and corrosion resistance than the conventional stainless steels has been developed, and recently found its way in the application to tubes for sea water heat exchangers, rolls for paper manufacturing, etc.

The two phase stainless steel as described above, however, has not yet been put into wide actual use, with various characteristics thereof still being left to be found. Accordingly, at the present stage, stainless steel of 18-8 group or 18-8-Mo group mentioned earlier is mainly used, but since the stainless steel of the above kind has allowable stress lower than the 13 Cr steel, it has not been brought into actual use with full confidence under the present circumstances.

Accordingly, an essential object of the present invention is to provide a stainless cast steel of high corrosion resistance and high strength medium Cr low Ni group which is extremely superior in yield strength to conventional stainless steels of 18-8 group or 18-8-Mo group and can sufficiently be applicable to various circumstances influenced by strong acids, with substantial elimination of disadvantages inherent in stainless cast steels of the kind.

Another important object of the present invention is to provide a stainless cast steel of the above described type which is stable and reliable in structure and performance, and can be readily manufactured through simple processings at low cost.

A further object of the present invention is to provide a method of producing a stainless cast steel of the above described type.

In accomplishing these and other objects, according to one preferred embodiment of the present invention, the high corrosion resistant and high strength medium Cr and low Ni stainless cast steel includes, in weight percentage, C (carbon): 0.1% and below, Si (silicon): 1.5% and below, Mn (Manganese): 2.0% and below, P (phosphorus): 0.04% and below, S (sulphur): 0.04% and below, Cr (chromium): 17.0% to 20.0%, Ni (nickel): 3.0% to 7.0%, Mo (molybdenum): 1.5% to 2.5%, Cu (copper): 5.0% to 7.0%, N (nitrogen): 0.1% and below and remaining portion substantially of Fe to form material for the stainless cast steel when said material is further subjected to heat treatment under predetermined conditions as disclosed, stainless steels superior in yield strength and having stable corrosion resistance against strong acids are presented, with substantial elimination of disadvantages inherent in conventional stainless steels.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
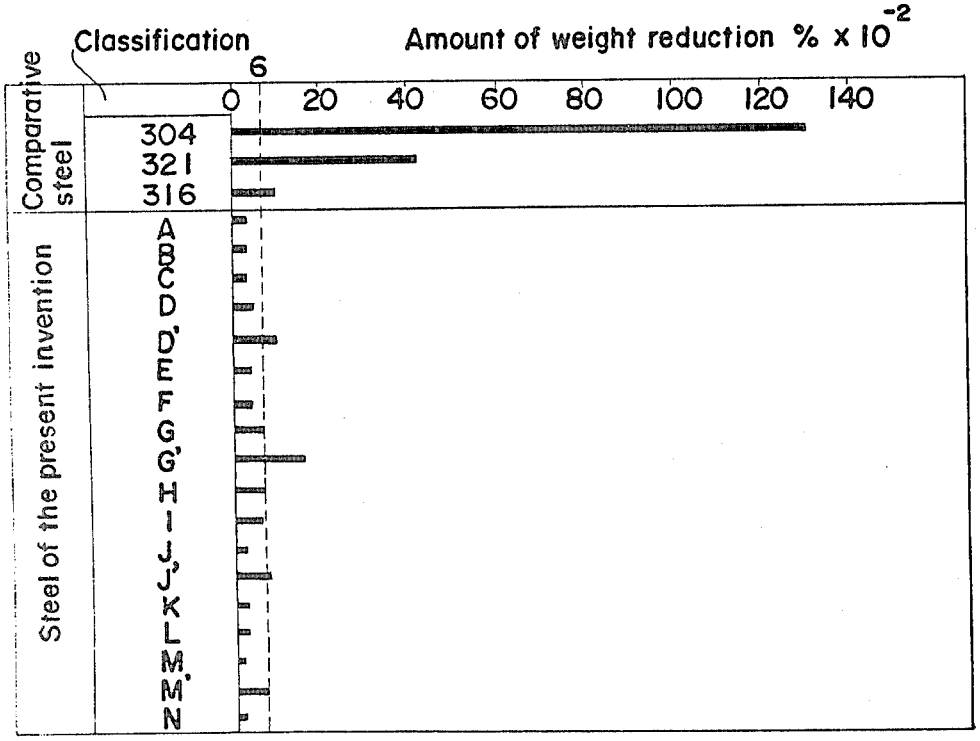
FIG. 1 is a graph showing results of comparative tests between conventional steels and steels according to the present invention in which amounts of weight reduction due to corrosion of sample stainless steels kept for six hours in boiling 5% sulfuric acid are given.

Referring now to the drawings, the present invention is described in detail hereinbelow.

In order to overcome the strength-wise disadvantages inherent in the 18-8 and 18-8-Mo group stainless steels mentioned earlier, the present inventors have made various studies on the characteristics of stainless steels in question, and as a result, developed novel stainless cast steels remarkably superior in yield strength as compared with the conventional 18-8 and 18-8-Mo group stainless steels and fully applicable to any circumstances affected by strong acids in actual use.

Before the description of the present invention, it is to be noted that the invention is particularly characterized in the following points.

In a first invention, the stainless steel is composed in weight % of C: 0.1% and below, Si: 1.5% and below, Mn: 2.0% and below, P: 0.04% and below, S: 0.04% and below, Cr: 17.0% to 20.0%, Ni: 3.0% to 7.0%, Mo: 1.5% to 2.5%, Cu: 5.0% to 7.0%, N: 0.1% and below and remaining portion substantially of Fe.

In a second invention, the material of the first invention is subsequently subjected to solution heat treatment at temperatures at least in the region from 900° to 1,150° C.

In a third invention, the resultant material of the second invention thus subjected to the solution heat treatment is further heated up to 600° to 700° C. with subsequent cooling for heat treatment.

In a fourth invention, the resultant material of the third invention is further subjected to precipitation hardening treatment at temperatures of 450° to 600° C.

In a fifth invention, the stainless steel is composed in weight % of C: 0.1% and below, Si: 1.5% and below, Mn: 2.0% and below, P: 0.04% and below, S: 0.04% and below, Cr: 17.0% to 20.0%, Ni: 3.0% to 7.0%, Mo: 1.5% to 2.5%, Cu: 2.5% to 5.0%, W; 0.2% to 2.0%, N:

0.1% and below and remaining portion substantially of Fe, while said Mo and Cu are set in composition at a range of Mo+Cu: 5.0 to 7.0 in weight %.

In a sixth invention, the material of the fifth invention is subsequently subjected to solution heat treatment at temperatures at least in the region from 900° to 1,150° C.

In a seventh invention, the resultant material of the sixth invention is further heated up to temperatures of 600° to 700° C. with subsequent cooling for heat treatment.

In an eighth invention, the resultant material of the seventh invention is further subjected to precipitation hardening treatment at temperatures of 450° to 600° C.

Reasons for limiting the range of the elements as described above will be described in detail hereinbelow. It is preferable that the amount of the element C is as small as possible, and C of more than 0.1% deteriorates the corrosion resistance. Although the element Si improves resistance against oxidation, inclusion thereof by more than 1.5% tends to reduce tenacity. Mn is necessary for desulfurization, but inclusion thereof by more than 2.0% deteriorates corrosion resistance. Inclusion of the element P by more than 0.04% obstructs welding performance, while the amount of S should preferably be as small as possible from the viewpoint of resistance against pitting and set to be not more than 0.04%. While Cr which is the important element for constituting stainless steel remarkably improves corrosion resistance, inclusion thereof up to 17.0% is not very effective, and if more than 20.0%, tenacity is reduced. For improving mechanical properties and general corrosion resistance of the steel to form martensite and ferrite structures, inclusion of Ni should preferably be in the region of 3.0 to 7.0%. Amount for inclusion of Cu known as the element for improving the corrosion resistance of stainless steel against non-oxidizing acids is normally from 0.2 to 1.3% (solid solubility phase in ferrite phase is 1.25% at 840° C.), and if the amount exceeds the above level, Curich phase ($\sigma$ phase) is precipitated for precipitation hardening, thus strength of the material being remarkably improved, although excessive precipitation expedites development of local corrosion and is not desirable from the viewpoint of tenacity. Accordingly, proper amount of inclusion of Cu is between 2.5 and 7.0% and is set to be in the region from 5.0 to 7.0% in the first to fourth inventions, taking into account the composite addition effect with respect to Mo mentioned later, and in the region from 2.5 to 5.0% in the fifth to eighth inventions from the viewpoint of the composite addition effect with respect to Mo and addition of W referred to later. The element Mo which remarkably improves resistance against local corrosion is required to be included by at least 1.5 to 2.5% in the amount, but is not preferable to be included by more than 2.5% from the viewpoint of strength, since martensite transformation is started at normal temperature or at temperatures less than the normal temperature, and thus improvement of the corrosion resistance by composite addition together with Cu becomes important, with the proper amount of Cu for optimum result being in the region of 5.0 to 7.0% as described earlier. The element W (tungsten) which is important in the fifth to eighth inventions has a particular effect for improvement of corrosion resistance against strong acids when present together with Cu, Mo, etc. In the range of the amount of inclusion of Cu from 2.5 to 5%, the above effect is particularly conspicuous at the weight percentages of Mo+Cu from 5.0 to 7.0% and W of 0.2 to 2.0% as is clear from Example mentioned later. Although the element N is important for improving resistance against pitting, tenacity tends to be reduced if N is contained by more than 0.1%, due to precipitation of nitrides, and therefore, the amount of N is set to be not more than 0.1%.

It should be noted here that in the foregoing description, although the reasons for limiting the range of composition are described with reference to the effects of individual elements, the present invention is not based on the mere addition of these elements, but is characterized in exhibiting effect more than the sum of the effects of the individual elements in the corrosion resistance and yield strength through interaction and multiplication of the above described effects as is clear from Example explained in detail hereinbelow.

EXAMPLE

Table 1 below shows chemical compositions and conditions of heat treatment for samples of comparative steels and steels according to the present invention.

TABLE 1

| Classification | | Chemical Composition (wt-%) C | Si | Mn | P | S | Cr | Mo | Ni | N | Cu | W | Ti | Heat Treatment |
|---|---|---|---|---|---|---|---|---|---|---|---|---|---|---|
| Comparative steels | AISI 304 | 0.08 | 0.91 | 0.84 | 0.021 | 0.015 | 19.1 | — | 8.9 | 0.06 | — | — | — | 1,050° C. × 4hr |
| | AISI 321 | 0.07 | 0.89 | 0.78 | 0.024 | 0.018 | 18.9 | — | 9.4 | 0.04 | — | — | 0.42 | Water cooling |
| | AISI 316 | 0.06 | 0.87 | 0.80 | 0.022 | 0.016 | 17.5 | 2.5 | 11.5 | 0.05 | — | — | — | |
| | A | 0.06 | 1.01 | 0.97 | 0.016 | 0.013 | 17.0 | 2.0 | 7.1 | 0.03 | 6.8 | — | — | (a) |
| | B | 0.07 | 1.21 | 0.84 | 0.021 | 0.016 | 18.1 | 1.8 | 7.4 | 0.04 | 6.9 | — | — | (b) |
| | C | 0.08 | 1.18 | 0.78 | 0.019 | 0.015 | 17.8 | 1.9 | 7.2 | 0.03 | 7.0 | — | — | (c) |
| | D | 0.06 | 1.10 | 1.01 | 0.018 | 0.013 | 18.0 | 1.7 | 6.4 | 0.05 | 6.2 | — | — | (a) |
| | D' | 0.06 | 1.10 | 1.01 | 0.018 | 0.013 | 18.0 | 1.7 | 6.4 | 0.05 | 6.2 | — | — | Without heat treatment |
| | E | 0.06 | 1.13 | 0.99 | 0.017 | 0.014 | 18.2 | 1.7 | 6.5 | 0.06 | 6.5 | — | — | (b) |
| Steels of Present invention | F | 0.07 | 0.92 | 1.21 | 0.013 | 0.015 | 18.4 | 1.6 | 6.4 | 0.04 | 6.3 | — | — | (c) |
| | G | 0.08 | 0.83 | 0.99 | 0.026 | 0.016 | 18.1 | 1.5 | 5.1 | 0.03 | 5.1 | — | — | (a) |
| | G' | 0.08 | 0.83 | 0.99 | 0.026 | 0.016 | 18.1 | 1.5 | 5.1 | 0.03 | 5.1 | — | — | Without heat treatment |
| | H | 0.07 | 1.26 | 0.92 | 0.019 | 0.013 | 18.3 | 1.6 | 5.0 | 0.04 | 5.4 | — | — | (b) |
| | I | 0.06 | 0.99 | 0.98 | 0.020 | 0.014 | 18.9 | 1.5 | 5.3 | 0.03 | 5.3 | — | — | (c) |
| | J | 0.08 | 0.98 | 0.93 | 0.021 | 0.016 | 19.0 | 2.2 | 4.1 | 0.04 | 4.6 | 0.21 | — | (a) |
| | J' | 0.08 | 0.98 | 0.93 | 0.021 | 0.016 | 19.0 | 2.2 | 4.1 | 0.04 | 4.6 | 0.21 | — | Without heat treatment |
| | K | 0.09 | 1.02 | 0.89 | 0.019 | 0.016 | 19.3 | 2.2 | 4.2 | 0.04 | 4.7 | 0.27 | — | (b) |
| | L | 0.06 | 1.13 | 1.10 | 0.020 | 0.015 | 19.7 | 2.3 | 4.0 | 0.05 | 4.8 | 0.34 | — | (c) |
| | M | 0.07 | 1.14 | 1.02 | 0.021 | 0.013 | 19.8 | 2.2 | 3.5 | 0.03 | 3.0 | 0.36 | — | (b) |
| | M' | 0.07 | 1.14 | 1.02 | 0.021 | 0.013 | 19.8 | 2.2 | 3.5 | 0.03 | 3.0 | 0.36 | — | Without heat treatment |
| | N | 0.08 | 1.05 | 1.11 | 0.022 | 0.012 | 19.8 | 2.1 | 2.9 | 0.04 | 2.9 | 0.39 | — | (c) |

Remaining portion: Fe

Subsequently, in order to assess the corrosion resistance of each of the steels in Table 1 against boiling 5% sulfuric acid, corrosion tests were carried out on a laboratory scale, in which test pieces each having dimensions of 10ϕ×30 mml were immersed for 6 hours in the boiling 5% sulfuric acid, with subsequent weighing for measuring the amount of weight reduction. In FIG. 1 showing the amount of weight reduction in %, the corrosion resistance against circumstances influenced by acids may be said to be extremely superior at the weight reduction less than 0.06%. From the test results for the steels AISI 304, 321 and 316 given for comparison in FIG. 1, which are generally said to be superior in corrosion resistance, it is noticed that the samples for 304 and 321 have considerably large amounts of corrosion, while the sample for 316 is still subjected to an appreciable extent of corrosion, although the corrosion resistance thereof is improved to a considerable extent by the addition of Mo. On the contrary, each of the steels according to the present invention is found to be superior in the corrosion resistance.

Figure 2:
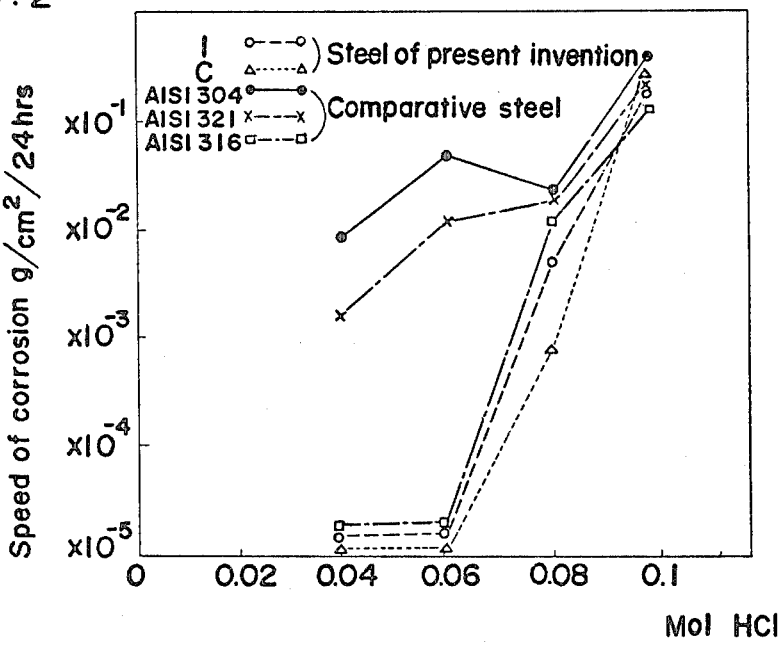
FIG. 2 is a graph also showing results of comparative tests between conventional steels and steels according to the present invention in which hydrochloric acid density and speed of corrosion ($g/cm^2/24$ hrs.) of stainless steel samples kept for twenty-four hours in 3% −NaCl+MOl HCl solution are given.

Referring also to FIG. 2 showing speed of corrosion of each of the steels of Table 1 in a three % solution of NaCl+HCl, the results of which were obtained by short-time accelerating evaluation of the resistance against pitting in condensation of $Cl^-$ concentration, the comparative steels AISI 304 and 321 had such large corrosion speeds at 0.02 HCl to 0.1 NHCl, as to be difficult to maintain passive state thereof for consequently being subjected to active dissolution, while the AISI 316 steel and steels according to the present invention where in the passive state up to 0.06 N HCl, with consequent very slow corrosion speed, and it is particularly noticed that the steels according to the present invention have the passive state more stable than the AISI 316 steel.

Subsequently, Table 2 below shows the state of precipitation hardening of Cu by the heat treatment of each of the steels in Table 1.

It is to be noted that in Tables 1 and 2, the symbols (a), (b) and (c) represent the following conditions for the heat treatment.

(a) Cooling by water after maintaining at temperature of 1,050° C. for 4 hours.

(b) Cooling by water after maintaining at temperature of 1,050° C. for 4 hours→Reheating up to 680° C. with subsequent cooling by air.

(c) Cooling by water after maintaining at temperature of 1,050° C. for 4 hours→Reheating up to 680° C. with subsequent cooling by air→Reheating up to 550° C. with subsequent cooling in furnace.

TABLE 2

| State of precipitation hardening of Cu by heat treatment | | | |
|---|---|---|---|
| Classification | | Heat treatment | 0.2% yield strength kg/mm² |
| Comparative steels | AISI 304 | (a) | 24.4 |
| | AISI 321 | (a) | 25.8 |
| | AISI 316 | (a) | 28.6 |
| Steels of the present invention | A | (a) | 38.5 |
| | B | (b) | 42.6 |
| | C | (c) | 50.6 |
| | D | (a) | 37.4 |
| | E | (b) | 40.8 |
| | F | (c) | 49.1 |
| | G | (a) | 35.6 |
| | H | (b) | 39.4 |
| | I | (c) | 48.9 |
| | J | (a) | 39.4 |
| | K | (b) | 46.3 |
| | L | (c) | 52.6 |
| | M | (b) | 44.7 |
| | N | (c) | 51.9 |

From the above Table 2, it is seen that in the 2% yield strength, although the comparative AISI 304, 321 and 316 steels are extremely low having values in the region of 24 to 27 kg/mm², the steels of the present invention each have high values, and particularly, the heat treatment conditions of (b) show higher effect than those of (a), while the heat treatment conditions of (c) show also higher effect than those of (b).

Meanwhile, Table 3 below shows the 0.2% yield strength in kg/mm² of the stainless steels of the present invention without any heat treatment (i.e., in the state as they are cast), and it is noticed from Table 3 that the steels of the present invention are superior to the comparative steels in this respect also.

TABLE 3

| Yield strengths of steels of the present invention without heat treatment | | |
|---|---|---|
| Classification | | 0.2% yield strength Kg/mm² |
| Steels of the present invention | D' | 36.8 |
| | G' | 35.0 |
| | J' | 38.7 |
| | M' | 39.1 |

As is clear from the foregoing description, although the strength increase in the steels according to the present invention is mainly attributable to inclusion of Cu at the amount of the predetermined range and also to the specific heat treatment, the effect is particularly conspicuous in the steels subjected to the heat treatment under the conditions (c) mentioned earlier, i.e., solution heat treatment at the temperature of 900° to 1,150° C., heating up to the temperatures from 600° to 700° C. with subsequent cooling, and further the precipitation hardening treatment at the temperatures of 450° to 600° C. In the above case, the reasons for limiting the temperatures for the second treatment to 600° to 700° C. are that the martensite transformation rate of the steels according to the present invention (temperatures for starting counter-transformation are in the region of 700° to 750° C.) in the first solid solution heat treatment is 80 to 85%, and that the rate of martensite formation is remarkably improved by heating up to the temperature immediately below the above counter-transformation temperature with subsequent cooling after the first heat treatment mentioned above. The temperatures are specified to be from 600° to 700° C., because such temperature range is best suited for the purpose.

Steels including elements in the composition range of the stainless cast steel according to the present invention and those further subjected to the heat treatment are extremely superior in yield strength to the conventional stainless steels, and thus practical stainless steels having stable corrosion resistance against circumstances influenced by strong acids especially in chemical industry, paper manufacturing industry, etc. are advantageously presented. The steels of the present invention particularly suitable for use in suction roll shells for paper manufacturing can also be used for any industrial components and parts which require the various characteristics as described in the foregoing.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A method of producing a high corrosion resistant and high strength medium Cr and low Ni stainless cast steel which consists of the steps of first preparing a molten material substantially of Fe, adding to said Fe material the following components: C: 0.1% and below, Si: 1.5% and below, Mn: 2.0% and below, P: 0.04% and below, S: 0.04% and below, Cr: 17.0% to 20.0%, Ni: 3.0 to 7.0%, Mo: 1.5% to 2.5%, Cu: 5.0% to 7.0%, N: 0.1% and below in weight percentage to form the base material and casting the base material to form a stainless cast steel.

2. A method of producing a high corrosion resistant and high strength medium Cr and low Ni stainless cast steel which consists of the steps of preparing a molten material substantially of Fe, adding to said Fe material the following components: C: 0.1% and below, Si: 1.5% and below, Mn: 2.0% and below, P: 0.04% and below, S: 0.04% and below, Cr: 17.0% to 20.0%, Ni: 3.0% to 7.0%, Mo: 1.5% to 2.5%, Cu: 2.5% to 5.0%, W: 0.2% to 2.0%, N: 0.1% and below in weight percentage to form the base material, setting the said Mo and Cu contents in the weight percentage to be in the range Mo+Cu: 5.0% to 7.0% and casting the base material to form a stainless cast steel.

3. A high corrosion resistant and high strength medium Cr and low Ni stainless cast steel which consists essentially of, in weight percentage, C: 0.1% and below, Si: 1.5% and below, Mn: 2.0% and below, P: 0.04% and below, S: 0.04% and below, Cr: 17.0% to 20.0%, Ni: 3.0% to 7.0%, Mo: 1.5% to 2.5%, Cu: 5.0% to 7.0%, N: 0.1% and below and the remaining portion substantially of Fe to form the material of said stainless cast steel.

4. A high corrosion resistant and high strength medium Cr and low Ni stainless cast steel which consists essentially of, in weight percentage, C: 0.1% and below, Si: 1.5% and below, Mn: 2.0% and below, P: 0.04% and below, S: 0.04% and below, Cr: 17.0% to 20.0%, Ni: 3.0% to 7.0%, Mo: 1.5% to 2.5%, Cu: 2.5% to 5.0%, W: 0.2% to 2.0%, N: 0.1% and below and the remaining portion substantially of Fe to form the material of said stainless cast steel, with said Mo and Cu contents in the weight percentage being set to be in range of Mo+Cu: 5.0% to 7.0%.

* * * * *